US007241184B2

(12) United States Patent
Kuo

(10) Patent No.: US 7,241,184 B2
(45) Date of Patent: Jul. 10, 2007

(54) CABLE CONNECTOR ASSEMBLY

(75) Inventor: Peter Kuo, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/541,244

(22) Filed: Sep. 29, 2006

(65) Prior Publication Data

US 2007/0077825 A1 Apr. 5, 2007

(30) Foreign Application Priority Data

Sep. 30, 2005 (CN) ..... 2005 1 0094680

(51) Int. Cl.
*H01R 13/40* (2006.01)

(52) U.S. Cl. ..... 439/686; 439/604

(58) Field of Classification Search ..... 439/686, 439/684, 687, 692, 695, 696, 604
See application file for complete search history.

(56) References Cited

U.S. PATENT DOCUMENTS 4,582,384 A * 4/1986 Frantz et al. ..... 439/610
5,879,196 A * 3/1999 Lee ..... 439/660
6,932,640 B1 * 8/2005 Sung ..... 439/405
6,957,970 B2 * 10/2005 Weigel et al. ..... 439/320

* cited by examiner

*Primary Examiner*—Hien Vu
(74) *Attorney, Agent, or Firm*—Wei Te Chung

(57) ABSTRACT

A cable connector assembly (1000) includes a cap (100 and a plug (300) received in the cap (100). The cap includes a base portion (10) defining a rear receiving chamber (13) and a plurality of front passageways (11) communicating with the receiving chamber (13). The plug (300) includes a plurality of terminals (3) and a cable (4) electrically connecting with the terminals (3). The plug (300) further comprises an inserting housing (2) to receive the plurality of terminals (3), the inserting housing (2) defines a plurality of receiving slots (21) corresponding to the number of the front passageways (11) of the cap (100), the terminals (3) are respectively received in the receiving slots (21), the cable connector assembly (1000) further comprises a mold (500) formed at the rear side of the cap (100) and the inserting housing (2) and enclosing front portion of the cable (4).

10 Claims, 5 Drawing Sheets

CABLE CONNECTOR ASSEMBLY

BACKGROUND OF THE INVENTION

1. Field of the Invention

The present invention generally relates to a cable connector assembly, and more particularly to a power connector assembly.

2. Description of Related Art

A general power connector assembly comprises an insulative housing, a plurality of terminals received in the insulative housing and a plurality of wires connecting with the terminals. Each wire comprises a plurality of conductors and an outer jacket. The way of connecting the terminal and the wire usually has two types relative to the soldering and the crimping. The manner of soldering is to melt the solder for connecting the wire and the terminal together. Especially, there is a way of punching a hole on the tail portion of the terminal, then soldering the terminal and the wire after the conductor pass through the hole. The manner of crimping utilizes the tail portion of the terminal to crimp the conductor of the wire.

However, with the development of the computer science, the computer is capable of undertaking many complicated tasks and many multimedia applications to affect every scope of society. Accordingly, the power increases with the high frequency of the CPU (Central Processing Unit) and many peripheral devices. Because of the invariable voltage, the higher electrical current is needed accordingly. Therefore, the size of conductor is required to enlarge to adapt to the high current, and the hole of the tail portion of the terminal needs to be changed according to the size of the conductor. Therefore, the size of the terminals needs to be enlarged which goes against the trend of compact size of the electronics. Thus, the 250 type terminal (similar to the terminal shown in FIG. 2) usually crimps with the conductor of the wire. However, the retention force between the single terminal and the conductor may be not enough, and in some conditions, the conductor and the terminal breakaway under unexpected exerted force. Therefore, it has possibility of damaging the devices under this unstable electrical connection.

Hence, an improved electrical connector assembly is needed to overcome the disadvantages of the related art.

SUMMARY OF THE INVENTION

Accordingly, an object of the present invention is to provide a cable connector assembly with stable electrical connection between a plurality of terminals and a plurality wires.

In order to achieve the object set forth, an cable connector assembly in accordance with present invention comprises a cap and a plug received in the cap. The cap includes a base portion defining a rear receiving chamber and a plurality of front passageways communicating with the receiving chamber. The plug includes a plurality of terminals and a cable comprising a plurality of cores electrically connecting with the terminals. Each terminal includes a crimping portion, a contacting portion and an interconnecting portion connecting with the retentive portion and the contacting portion. The plug further comprises an inserting housing to receive the plurality of terminals, the inserting housing defines a plurality of receiving slots corresponding to the number of the front passageways of the cap, the terminals are respectively received in the receiving slots, the cable connector assembly further comprises a mold formed at the rear side of the cap and the inserting housing and enclosing front portion of the cable.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
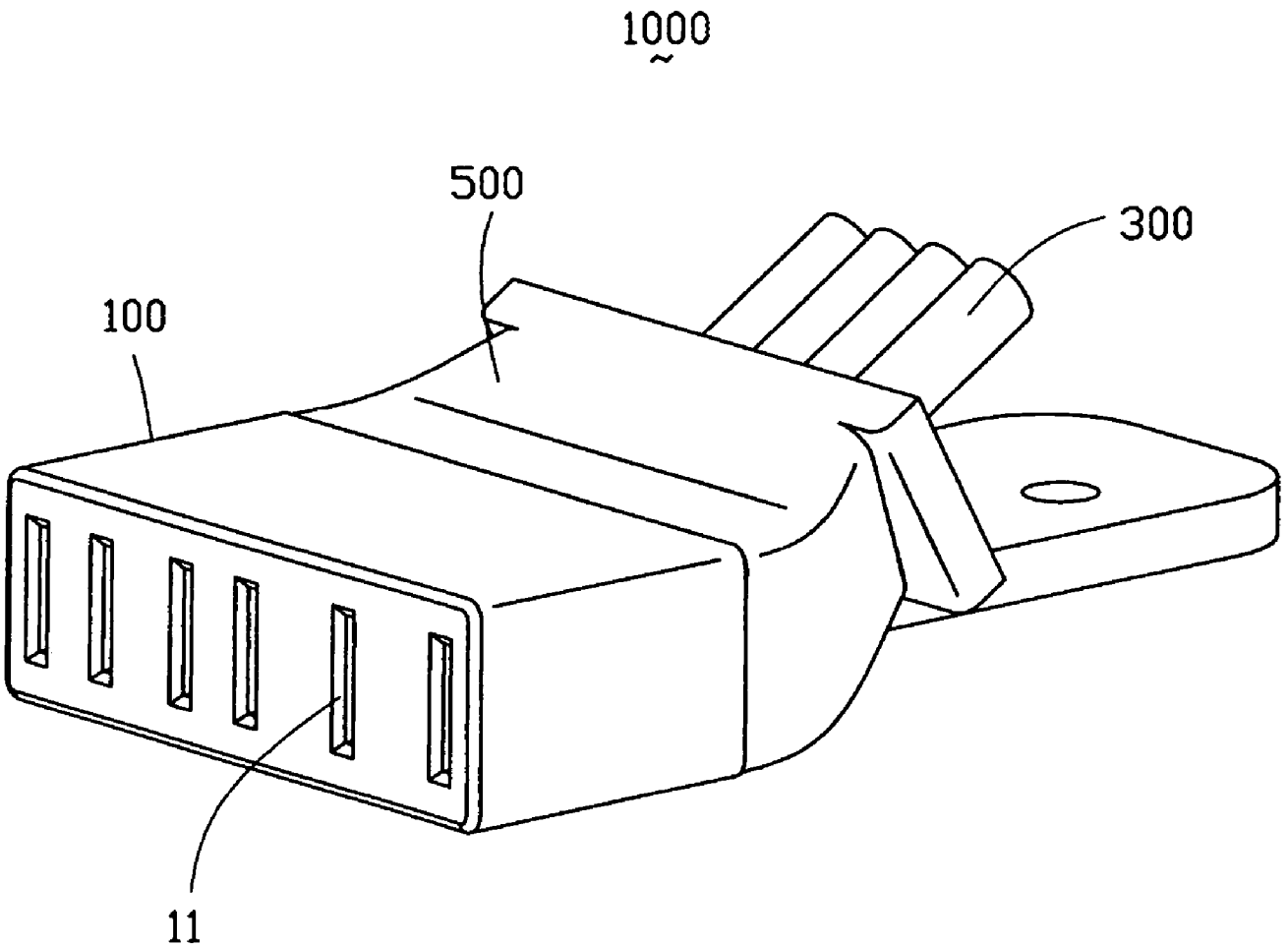
FIG. 1 is an assembled, perspective view of a cable connector assembly in accordance with the present invention.
Figure 2:
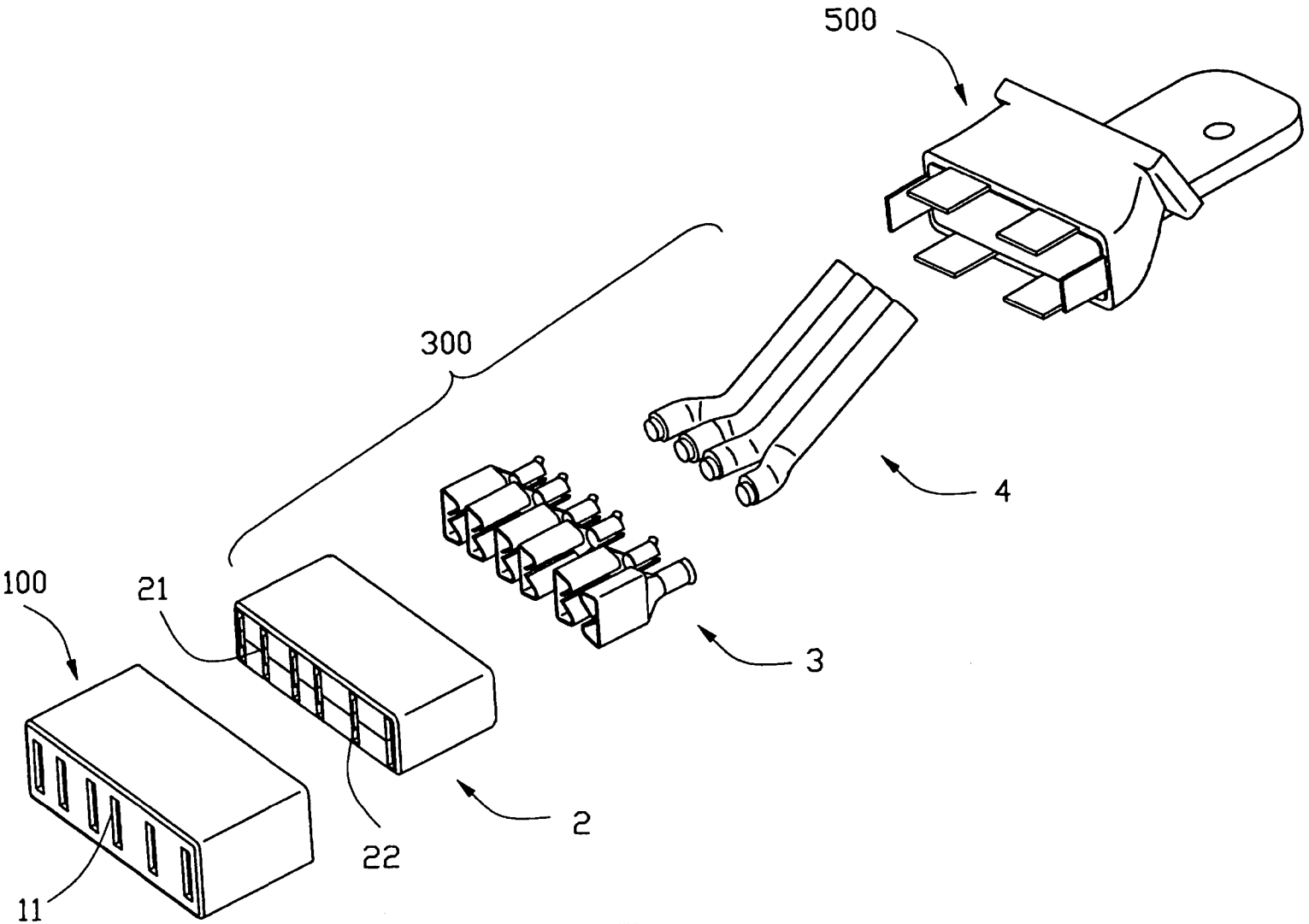
FIG. 2 is a partially exploded, perspective view of the cable connector assembly shown in FIG. 1.

Referring to FIG. 1, a cable connector assembly 1000 in accordance with the present invention comprises a cap 100, a plug 300 receiving in the cap 100 and a mold 500 enclosing the rear portion of the plug 300 and engaging with the cap 100. In preferred embodiment, X, Y and Z are respectively designated to the front, right and up directions.

Referring to FIGS. 1-5, the cap 100 is substantially rectangular, and comprises a base portion 10. The base portion 10 comprises a top wall 101, a bottom wall 102 opposite to the top wall 101, a pair of side walls 103, 104, and a front wall 105 connecting with the top wall 101, the bottom wall 102 and the pair of side walls 103, 104. The walls 101, 102, 103, 104 and 105 together define a receiving chamber 13 opening toward rear side. The front wall 105 defines a plurality of passageways 11 communicating with the receiving chamber 13. The top wall 101, the bottom wall 102 and the pair of side walls 103, 104 respectively defines a plurality of recesses 12 extending along a back-to-front direction and communicating with the receiving chamber 13.

The plug 300 comprises an inserting housing 2, a plurality of terminals 3 received in the inserting housing 2 and a cable 4 electrically connecting with the terminals 3.

The inserting housing 2 is of rectangular shape and configured to couple with the receiving chamber 13 of the cap 100. The inserting housing 2 comprises an upper seat 26 and a lower seat 24. The lower seat 24 comprises a longitudinal body portion 240. The body portion 240 defines a plurality of receiving grooves 241 therein communicating with an exterior in both the longitudinal direction and an upright direction and corresponding to the passageways 11. Each receiving groove 241 comprises a front receiving portion 2411 and a rear semi-circular accommodating portion 2412. The receiving portion 2411 further defines a retentive block 2413 adjacent to the accommodating portion 2412. The body portion 240 defines a plurality of notches 242 at the front wall thereof and respectively communicating with the receiving grooves 241. The upper face of the body portion 240 defines a plurality of retaining holes 243 extending downwardly at predetermined distance and located between the adjacent receiving grooves 241. The upper seat 26 is substantially same as the lower seat 24 and symmetrically configured one another. The upper seat 26 comprises a plurality of receiving grooves 261 and a plurality of notches 262 communicating with the receiving slots 261. Each receiving groove 261 further comprises a front receiving portion 2611, a rear semi-circular accommodating portion 2612 and a retentive block 2613 either. The upper seat 26 further comprises a plurality of retaining posts 263 located between the adjacent receiving slots 261 and cooperating with the retaining holes 243. When the upper seat 26 is assembled with the lower seat 24, the receiving grooves 241 and the corresponding receiving grooves 261 together form a plurality of receiving slots 21. Each receiving slot 21 comprises a receiving portion, a retentive block and a circular accommodating portion (not labeled). Each notch 242 and each corresponding notch 262 together define a slit 22.

Figure 4:
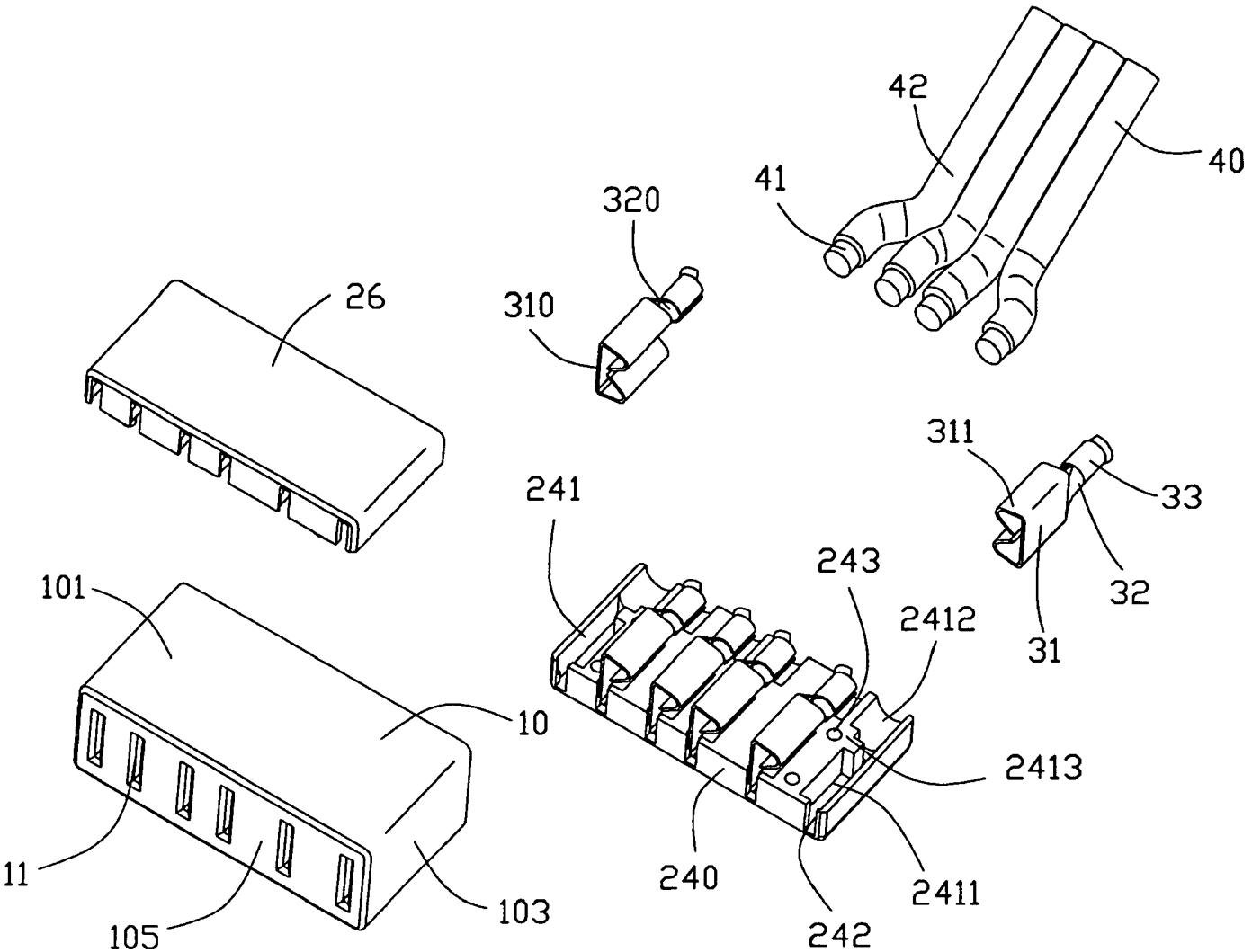
FIG. 4 is an exploded, perspective view of the cable connector assembly shown in FIG. 1, illustrating a plug thereof.
Figure 5:
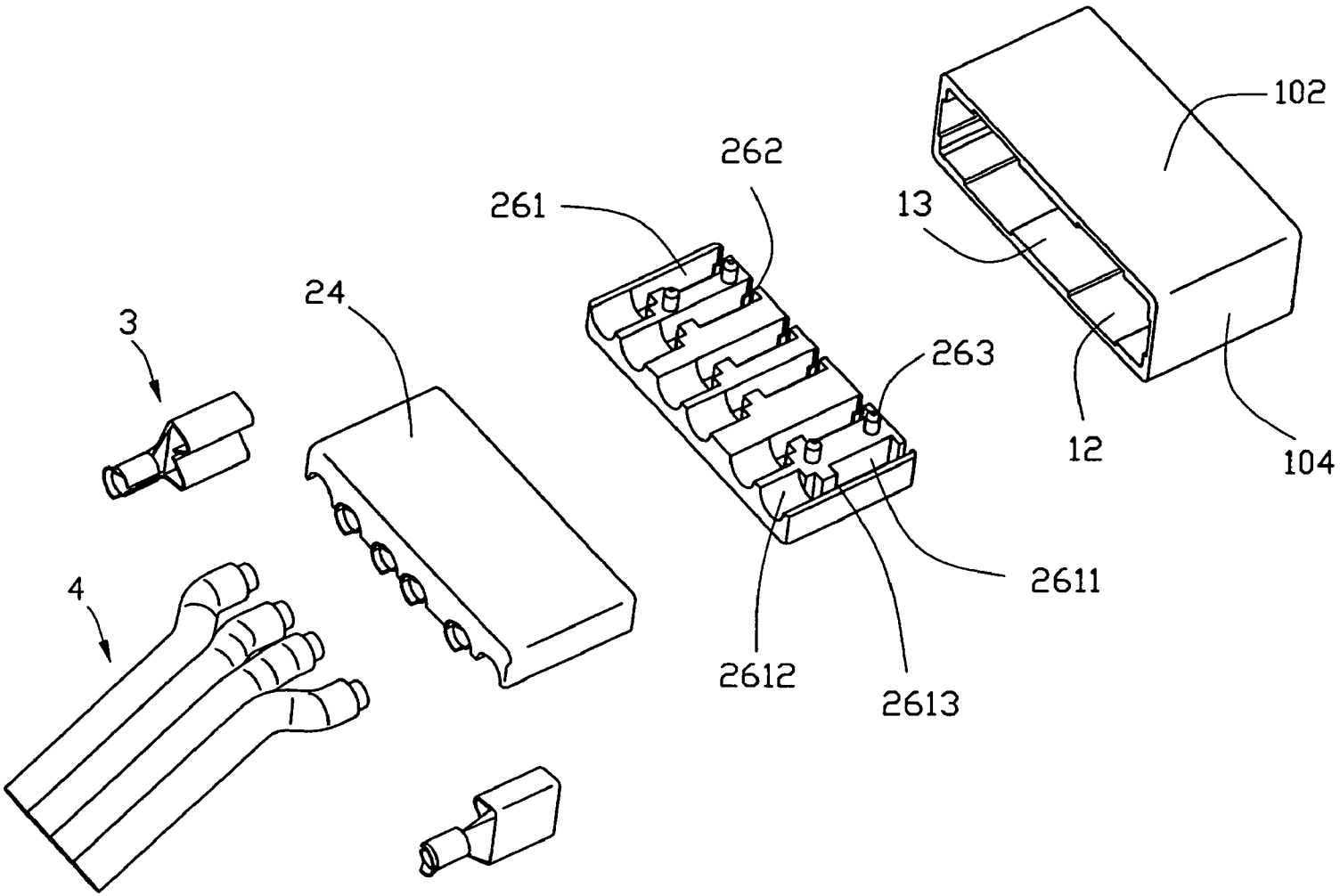
FIG. 5 is a view similar to FIG. 4, but taken from a different aspect.

Referring to FIG. 4, each terminal 3 is configured as symmetrically-shaped, and comprises a contacting portion 31, a crimping portion 33 for holding the cable 4 and an interconnecting potion 32 connecting with the contacting portion 31 and the crimping portion 33. The contacting portion 31 comprises a base section 310 and a pair of retaining sections 311 respectively extending transversely from the upper side and the lower side of the base section 310 along horizontal plane and then slantwise extending toward the base section 310 and each other at an angle of 45 degrees. The interconnecting portion 32 is slantways configured. The crimping portion 33 is substantially an unsealed circle for crimping the cable 4. The retaining sheet 311 and the crimping portion 33 are located at the same side of the base section 310. The interconnecting portion 32, the contacting portion 31 and the retaining portion 33 together define a concave 320.

Referring to FIG. 4, the cable 4 comprises a plurality of single ended wires 40, and each wire 40 further comprises a core 41 and an outer jacket 42 enclosing the core 41.

Figure 3:
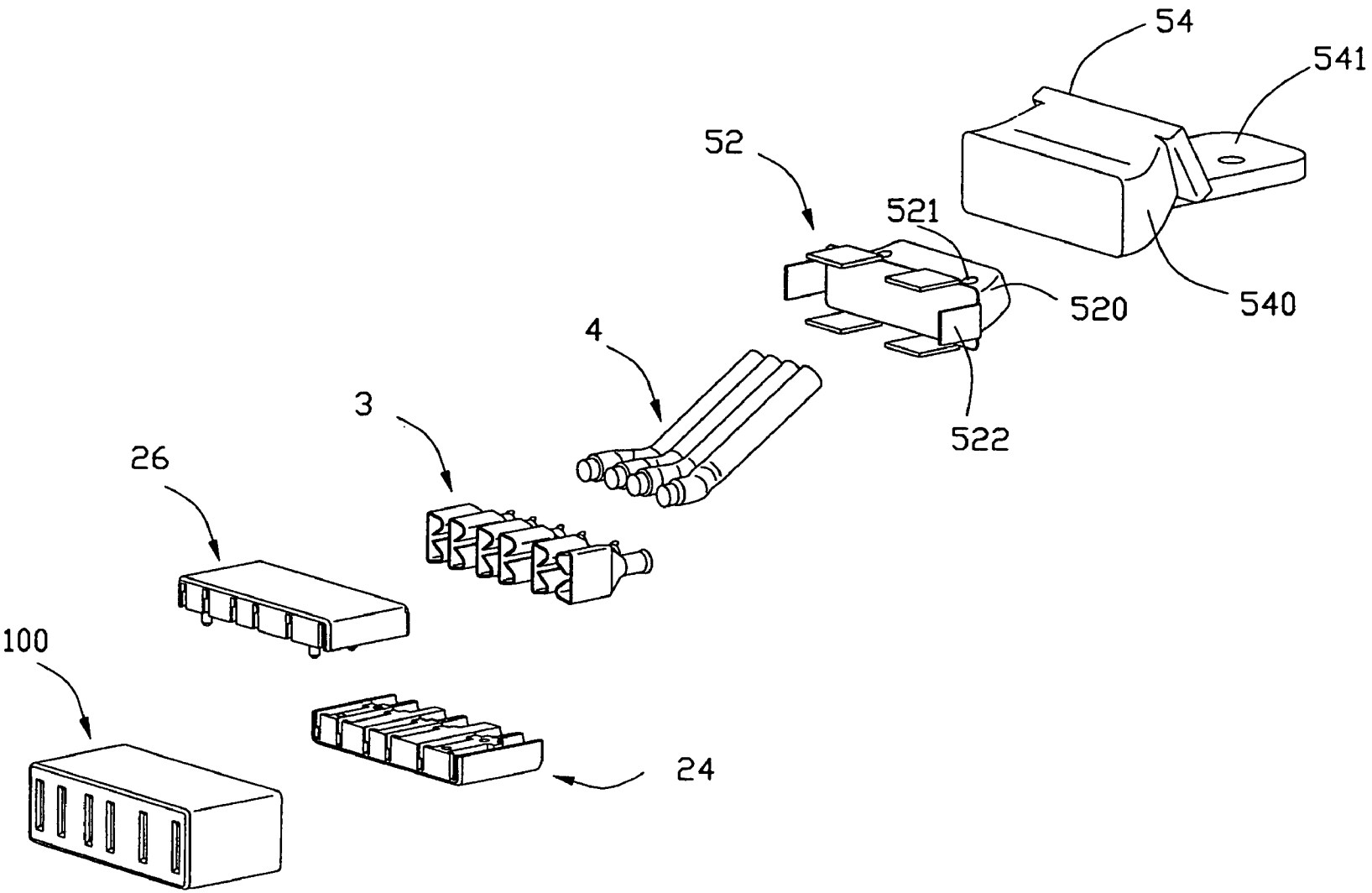
FIG. 3 is a further exploded, perspective view similar to FIG. 2, but taken from a different aspect.

Referring to FIG. 3, the mold 500 is made of plastic materials and comprises an inner mold 52 and an outer mold 54 whose materials is harder than that of inner mold 52.

Referring to FIGS. 1-5, the cable connector assembly 1000 will be assembled as follows:

The first step is to connect the cable 4 with the terminals 3. Firstly, the outer jacket 42 of the wire 40 is partially stripped and the core 41 is exposed outside, then the crimping portion 33 wraps the core 41 of the wire 40.

The second step is to assemble the terminals 3 into the inserting housing 2. The terminals 3 can be firstly assembled to the upper seat 26 or the lower seat 24. In preferred embodiment, the terminals 3 are firstly assembled to the lower seat 24 with lower half of the contacting portions 31 respectively received in the receiving portions 2411 of the receiving grooves 241, lower half of the crimping portions 33 received in the accommodating portions 2412, and the concaves 320 of the terminals 3 engaging with the retentive blocks 2413 of the receiving portions 2411 for preventing the terminals 3 escaping from the receiving grooves 241. Then, the upper seat 26 is assembled to the lower seat 24 with the retaining posts 263 respectively engaging with the retaining holes 243. Thus, the inserting housing 2 is formed and the terminals 3 are entirely received in the receiving slots 21. By now, the assembly of the plug 300 is accomplished.

The third step is to assemble the plug 300 into the cap 100.

The forth step is to form an inner mold over the above assembly. After the plug 300 assembled into the cap 100, an inner mold 52 is insert-molded at the rear side of the cap 100. The inner mold 52 comprises a substantially rectangular main body 520 and a plurality of extending portions 522 extending into the recesses 12 of the cap 200. The main body 520 further defines a pair of engaging holes 521. The main body 520 encloses the connections formed by the terminals 3 and the cable 4, and the extending portions 522 fill up the holes form by the recesses 12 of the cap 100 and the outer periphery of the inserting housing 2. Therefore, the inner mold 52 assures a firm engagement between the plug 30 and the cap 100. Furthermore, the cable 4 is partially enclosed by the inner mold 52 to provide a stain-relief function.

the last step is to form an outer mold 54 over the inner mold 52. The melt plastic materials enclose the inner mold 52 and a part of the cable 4 and further flow into the engaging holes 522. After cool, the outer mold 54 is formed. The outer mold 54 comprises a main body 540 and a mounting means 541 disposed at rear side of the main body 540.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

a cap comprising a base portion, the base portion defining a rear receiving chamber and a plurality of front passageways communicating with the receiving chamber;

a plug received in the cap comprising:

a plurality of terminals and each comprising a crimping portion, a contacting portion and an interconnecting portion connecting with the retentive portion and the contacting portion;

a cable comprising a plurality of cores electrically connecting with the terminals; and wherein the plug further comprises an inserting housing to receive the plurality of terminals, the inserting housing defines a plurality of receiving slots corresponding to the number of the front passageways of the cap, the terminals are respectively received in the receiving slots, the cable connector assembly further comprises a mold formed at the rear side of the cap and the inserting housing and enclosing front portion of the cable;

wherein the cap comprising a base portion, the base portion further comprises a top wall, a bottom wall opposite to the top wall, a pair of side walls, and a front wall connecting with the top wall, the bottom wall and the side walls form the receiving chamber;

wherein the cap defines a plurality of recesses extending along the back-to-front direction at the inner walls thereof;

wherein the mold further comprises an inner mold enclosing the rear portion of the plug and an outer mold over-molding on the inner mold.

2. The cable connector assembly as claimed in claim 1, wherein the inner mold comprises a body portion enclosing the connection of the terminals and the cable and a plurality of extending portions extending into the cap and filling up the recesses of the cap.

3. The cable connector assembly as claimed in claim 1, wherein the inserting housing comprises a plurality of receiving slots and a plurality of slits corresponding to the receiving slots, each of said receiving slot comprises a receiving portion, a retentive block form in the receiving portion and a circular accommodating portion, the contacting portion, the interconnecting portion and the crimping portion of the terminal are respectively received in the receiving slot and the accommodating portion of the receiving slot of the inserting housing, and the retentive block engages with the concave of the terminal.

4. The cable connector assembly as claimed in claim 3, wherein the crimping portion of the terminal is an unsealed circle and wraps over the corresponding core of the cable, The contacting portion comprises a base section and a pair of retaining sections respectively extending transversely from the upper side and the lower side of the base section along horizontal plane and then slantwise extending toward the base section at a angle of 45 degrees, the interconnecting portion is slantways configured.

5. The cable connector assembly as claimed in claim 4, wherein the retaining sheets of the contacting portion and the retaining portion are located at the same side of the base section, the contacting potion, the interconnecting portion and the crimping portion together define a concave.

6. The cable connector assembly as claimed in claim 3, wherein the inserting housing comprises an upper seat and a lower seat cooperating with the upper seat, said upper seat has the substantially same shape as the lower seat, and each comprises a body portion which defines a plurality of receiving slots.

7. The cable connector assembly as claimed in claim 6, wherein the upper seat defines at least a retentive post, the lower seat defines at least a retaining hole corresponding to the retaining post.

8. A cable connector assembly comprising:

an insulative housing including two halves assembled to each other, each defining a plurality of inner half grooves, one inner half groove of one half cooperating with another one inner half groove of the other half forming a contact receiving passageway;

a plurality of contacts each received in the corresponding passageway;

a cap circumscribing the housing;

a plurality of wires connected to the corresponding contacts, respectively; and an insulative cover overmolded on a rear portion of the housing and front portions of the wires, wherein the cap comprising a base portion, the base portion further comprises a top wall, a bottom wall opposite to the top wall, a pair of side walls, and a front wall connecting with the top wall, the bottom wall and the side walls form the receiving chamber;

wherein the cap defines a plurality of recesses extending along the back-to-front direction at the inner walls thereof;

wherein the cover further comprises an inner mold enclosing the rear portion of the housing and an outer mold over-molding on the inner mold;

wherein the cover defines a mounting section which is oblique to an outward extension direction of said wires.

9. The assembly as claimed in claim 8, wherein an exterior surface of said cover is essentially coplanar with that of the cap.

10. A cable connector assembly comprising:

an insulative housing defining a plurality of passageways;

a plurality of contacts each received in the corresponding passageway;

a cap circumscribing the housing;

a plurality of wires connected to the corresponding contacts, respectively; and an insulative cover overmolded on a rear portion of the housing and front portions of the wires; wherein the cover defines a mounting section which is oblique to an outward extension direction of said wires;

wherein the cap comprising a base portion, the base portion further comprises a top wall, a bottom wall opposite to the top wall, a pair of side walls, and a front wall connecting with the top wall, the bottom wall and the side walls form the receiving chamber;

wherein the cap defines a plurality of recesses extending along the back-to-front direction at the inner walls thereof;

wherein the cover further comprises an inner mold enclosing the rear portion of the housing and an outer mold over-molding on the inner mold.

* * * * *